United States Patent [19]

Knight et al.

[11] 4,036,556

[45] July 19, 1977

[54] PRECONDITIONING IMAGE TRANSFER AREAS IN DOCUMENT REPRODUCTION MACHINES

[75] Inventors: Arthur Holt Knight; Thomas Travis Underhill, both of Boulder, Colo.

[73] Assignee: International Business Machines Corporation, Armonk, N.Y.

[21] Appl. No.: 649,755

[22] Filed: Jan. 15, 1976

[51] Int. Cl.[2] ..... G03G 15/00

[52] U.S. Cl. ..... 355/14; 355/16

[58] Field of Search ..... 355/14, 16, 3 DR

[56] References Cited

U.S. PATENT DOCUMENTS

| | | | |
|---|---|---|---|
| 3,588,242 | 6/1971 | Berlier et al. | 355/16 |
| 3,697,169 | 10/1972 | Maksymiak et al. | 355/14 |
| 3,819,261 | 6/1974 | Ogawa | 355/14 |
| 3,976,374 | 8/1976 | Hickman | 355/14 |

*Primary Examiner*—L. T. Hix
*Assistant Examiner*—J. A. LaBarre
*Attorney, Agent, or Firm*—Herbert F. Somermeyer

[57] ABSTRACT

Newly inserted image transfer portions are subjected to a preset number of document reproduction machine operations. Such preconditioning modifies the image area such that physical properties of the image area are adjusted to ensure high-quality document reproduction.

11 Claims, 1 Drawing Figure

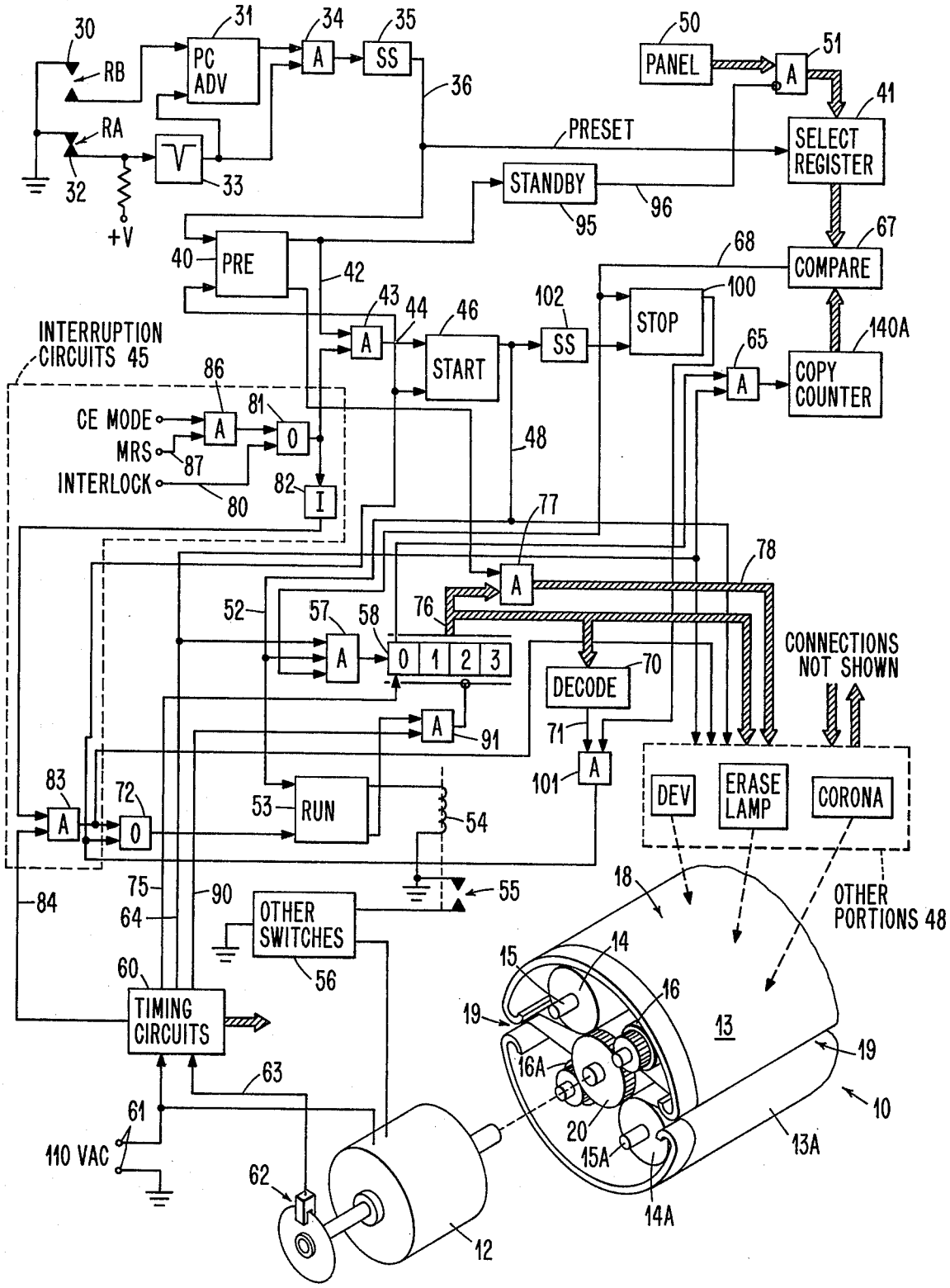
PC ADV
A
SS
PANEL
SELECT REGISTER
PRESET
STANDBY
PRE
COMPARE
STOP
START
COPY COUNTER
INTERRUPTION CIRCUITS 45
CE MODE
MRS
INTERLOCK
DECODE
CONNECTIONS NOT SHOWN
DEV
ERASE LAMP
CORONA
RUN
OTHER SWITCHES
OTHER PORTIONS 48
TIMING CIRCUITS
110 VAC
+V
RB
RA

PRECONDITIONING IMAGE TRANSFER AREAS IN DOCUMENT REPRODUCTION MACHINES

DOCUMENTS INCORPORATED BY REFERENCE

U.S. Pat. No. 3,588,242 shows a document reproduction machine in which the present invention can be advantageously practiced.

IBM TECHNICAL DISCLOSURE BULLETIN, Volume 15, Number 4, Sept. 1972, page 1261, shows a two-image area photoconductor drum which may be incorporated into the U.S. Pat. No. 3,588,242 illustrated machine.

BACKGROUND OF THE INVENTION

The invention relates to document reproduction machines and particularly to methods and apparatus for such machines which precondition photoconductors or other forms of image transfer areas for maintaining high-quality copies.

As shown in U.S. Pat. No. 3,588,242, an organic-type of photoconductor can be coated on a flexible member. The flexible member, i.e., a wide tape, is then incremented over a carrier such that as the photoconductor quality decreases, a new photoconductor area can be automatically incremented to an image transfer area. In this sense, a new image transfer area is placed in an operational position, i.e., is in a position to transfer images from a source to a copy.

In the manufacture of such organic photoconductors, centain vehicles are used in the coating process. Such vehicles include an oil-type material which can leave a residue. Such residue can cause graining and other imperfections in copies made on fresh or unused photoconductors. Such decreased copy quality is unsatisfactory in the commercial marketplace. Accordingly, after a new image area has been transferred to an operational position, some means must be provided to condition the photoconductor such that high-quality copies are always produced in a document reproduction machine. This preconditioning should be achieved with minimal interference with the normal day-to-day document reproduction activities performed by the machine.

SUMMARY OF THE INVENTION

It is an object of the present invention to provide efficient preconditioning function in a document reproduction machine for preconditioning newly received image transfer photoconductive material and the like.

In accordance with the invention, as soon as a new image transfer surface is disposed or is being disposed in an operational position, the document reproduction machine executes a preset number of machine cycles which include performing certain machine operations on the newly received image transfer area. In the event of interruption of the preconditioning process, the machine automatically reinstitutes the preconditioning step such that the preset number of cycles is achieved with or without interruptions. In a preferred form of practicing the invention, document reproduction is inhibited during the preset number of machine cycles. This action prevents production of substandard copies.

Preconditioning can use any one of several conditioning techniques; preferably a combination of such conditioning techniques is used. In one form of the invention, the image transfer area is preconditioned by using electrostatic-optical functions of the machine. In another, mechanical conditioning preconditions the image area. In a most-preferred form, both mechanical (toner or developer beads), plus electrostatic functions precondition the image area. A rotating brush of a cleaning station may clean the photoconductor. The electrostatic exposure can be by optical lamps, such as fluorescent or incandescent lamps with high voltage (corona) applied to the image transfer area member. In a preferred form, image developer brush voltage is kept at its lowest level with the exposing or image-creating lamp or the erasure lamp being on. It is desired that an erasure lamp be used as opposed to an image-creating lamp (document scanning lamp).

In the most-preferred form of the invention, the preconditioning with both the developer beads and electrostatics (lamps plus coronas) resulted in preconditioning in a period of time not exceeding one minute. In one constructed embodiment, a one minute preconditioning cycle was achieved in 75 machine cycles. For reducing the possibility of jam interference, the paper transport is inhibited, as well as associated machine functions related to copy production.

The foregoing and other objects, features, and advantages of the invention will become apparent from the following more particular description of a preferred embodiment thereof, as illustrated in the accompanying drawing.

THE DRAWING

The single FIGURE diagrammatically illustrates a preferred constructed embodiment of the present invention as the invention would be incorporated into the machine illustrated in U.S. Pat. No. 3,588,242.

DETAILED DESCRIPTION

The document reproduction machine set forth in U.S. Pat. No. 3,588,242 includes a photoconductor material coated on a flexible backing material such as a 3 mil Mylar plastic. The resulting photoconductor element 13 is thin and flexible with an extended length stored in roll form within the interior of photoconductor or copy drum. In a preferred form, two photoconductor elements 13 and 13A, in accordance with the above-cited IBM TECHNICAL DISCLOSURE BULLETIN article, are used in connection with a document reproduction machine. A pair of supply rolls 14 and 14A of unused or new photoconductor elements 13 and 13A are removably supported on supply spindles 15 and 15A with a pair of take-up rolls 16 and 16A, respectively, receiving used photoconductor elements 13 and 13A. The center of the portion 18 of the photoconductor element 13, in an operative position (acts as an image area) for transferring images, is located between the respective supply and take-up rolls and respectively extends through the axial slots 19 in the periphery of the copy drum. A motor 12 driving copy drum 10 also advances the photoconductor elements via center drive wheel 20 as fully explained in U.S. Pat. No. 3,588,242.

Also as shown in U.S. Pat. No. 3,588,242, the entire document reproduction machine includes a plurality of processing stations which carry out the conventional steps of xerographic copy production.

For brevity and simplicity, these stations are not shown in the figure. The electronic circuitry shown in block form is that circuitry added to the disclosure of U.S. Pat. No. 3,588,242 in order to incorporate the present invention into that document reproduction machine. The illustrated circuits are initiated by the apparatus shown in FIG. 9 of U.S. Pat. No. 3,588,242 at a time indicated in FIG. 10 U.S. Pat. No. (3,588,242) when the photoconductor element advance ends. This is indicated in U.S. Pat. No. 3,588,242 when the relay RB has opened and the relay RA has closed. Relay RB signifies that a photoconductor element advance is occurring, while the closure of the contacts of RA signifies that the advance has been completed. Accordingly, in the present application, a pair of normally open contacts 30 from relay RB of U.S. Pat. No. 3,588,242 connects an actuating ground reference potential to set photoconductor advance indicating (PC advance) latch 31 to the active condition. In FIG. 10 of U.S. Pat. No. 3,588,242, this action corresponds to the primary advance relay RB being active at the end of the copying operation and the beginning of the photoconductor element advance. At the conclusion of the advance, relay RA of U.S. Pat. No. 3,588,242 is released such that normally closed contacts 32 of this application close transfering an actuating ground reference potential to a differentiator circuit 33 of this application for supplying a resetting use to PC advance latch 31 as well as sampling AND circuit 34. AND circuit 34 was enabled by the PC advance latch 31 being set to the active condition and thereby passes the differentiator 33 pulse for activating a single shot (SS) monostable multivibrator 35 to emit a formed pulse of predetermined duration over line 36. The line 36 signifies to the control circuits of the figure of the present application to set the machine in a preconditioning mode.

The line 36 pulse sets preconditioning latch 40 signifying to the electronic circuits that the document reproduction machine is in a preconditioning mode. Additionally, the line 36 pulse presets the copy number select register 41 to the desired number of machine cycles to be executed during the preconditioning mode. In the constructed embodiment, the number selected is 75, the number of cycles required to expose the photoconductor elements 13 and 13A for about one minute. With document reproduction machines having differing machine cycles, the number can be altered to accommodate the desired time of exposure for achieving preconditioning. Because of the many variables involved with preconditioning, it is important that each design be empirically analyzed for determining desired reconditioning time.

From reading U.S. Pat. No. 3,588,242, it will be noted that the document reproduction machine is in a nonoperating condition during photoconductor element advance. For preconditioning, the machine is in an operating condition. Accordingly, as soon as preconditioning latch 40 is set to the active condition, it supplies an AND circuit enabling signal over line 42 for enabling AND circuit 43 to pass a noninterrupt signal received over line 44 from interruption circuits 45 to set start latch 46 to the active condition. Start latch 46, in addition to the functions performed in the illustrated figure, also enables power to be applied to the xerographic processing circuits of the document reproduction machine. Repowering amounts to activating power relay PR of U.S. Pat. No. 3,588,242. For enabling repowering, an activating signal is supplied by latch 46 over line 47 to other portions 48 of the document reproduction machine. Other portions 48 represent the xerographic processing stations associated with the photoconductor or copy drum 10, as described in U.S. Pat. No. 3,588,242. It is also to be understood that other portions 48 have interactions not described in the Pat. No. 3,588,242 with some of the electronic circuits illustrated herein. That is, select register 41, in addition to determining the number of machine cycles for the preconditioning mode, also is responsive to an operator control panel 50 via AND circuits 51 to indicate the number of copies to be made from a given original document. Such interconnections are not shown for brevity and are not necessary for an understanding of practicing the present invention with respect to the machine shown in the patent incorporated by reference.

Start latch 46 also supplies an activating signal over line 52 for setting run latch 53 to the active condition. Run latch 53, in turn, powers motor control relay 54 to close a pair of normally open contacts 55. These contacts provide ground reference potential through other switches 56, such as shown in FIG. 9 of U.S. Pat. No. 3,588,242, for energizing motor 12 to rotate copy drum 10 and power other mechanical portions of the document reproduction machine. Other mechanical portions are included in the diagrammatic representation 48. Motor 12 of the present application corresponds to motor 12 of FIG. 9 of U.S. Pat. No. 3,588,242. Additionally, start latch 46 also enables AND circuit 57 for passing copy cycle indicating signals (later described) for inserting indicating signals into shift register 58 for controlling the preconditioning mode, as will become more apparent.

Timing circuits 60 provide synchronized and nonsynchronized timing signals for operating the document reproduction machine. These timing signals are provided to other portions 48, as well as the illustrated circuits. The AC power supply indicated by terminals 61 generates a plurality of timing signals in synchronism with the power frequency. Terminals 61 also supply AC power to motor 12. Additionally, timing signals synchronous with the reproduction process are derived from tachometer 62 on copy drum 10. Tachometer 62 is also known as an emitter wheel. Tachometer 62 fiducial mark signals, i.e., representing image cycles of copy drum 10, are supplied over line 63 to timing circuits 60. As a result, timing circuits 60 generate a copy cycle initiating timing signal supplied over line 64. In addition to synchronizing other portions 48 to the copy drum 10 rotation, the image cycle indicating signal passes through AND circuit 57 to synchronously insert binary 1's in the low-order digit position of shift register 58. As such, each binary 1 in shift register 58 signifies a copy cycle of the document reproduction machine. Such binary 1's in register 58, as will be later explained, are used to terminate the preconditioning mode. Additionally, the image indicating signal travels through AND circuit 65 for incrementing copy counter 140A whenever the lowest digit position 0 of shift register 58 has a binary 1. Copy counter 140A is an electronic equivalent of the relay copy counter 140 of U.S. Pat. No. 3,588,242. Accordingly, copy counter 140A signifies the number of image cycles, or machine cycles, elapsed since start latch 46 was set to the active condition. To determine when the desired number of cycles has been completed, compare circuit 67 receives signals from select register 41 and copy counter 140A for detecting equality. When there is an equality, compare circuit 67 removes a noncompare active signal from line 68 thereby disabling AND circuit 57 and setting stop latch 100. This action inhibits a further introduction of binary 1's in the low-order state of shift register 58, while conditioning the illustrated circuits to terminate the preconditioning mode. When a binary 0 occurs in the low-order stage of shift register 58, AND circuit 65 is disabled thereby inhibiting further action of copy counter 140A. As will become apparent, the binary 1 in the low-order stage of shift register 58 is then shifted toward the most significant stage 3. Eventually, the binary 1 is shifted out leaving the signal content of shift register 58 equal to zero. When this occurs and the stop latch 100 has been set, the preconditioning mode has been completed. Decode circuit 70 responds to an all-0's condition of shift register 58 to supply a stop signal over line 71 via AND circuit 101 to reset run latch 53 via OR circuit 72, as well as resetting both the preconditioning latch 40 and start latch 46. Stop latch 100 being set conditions AND circuit 101 to pass the stop signal. At this time, a new copy run can be initiated from panel 50; and day-to-day operations of the document reproduction machine can ensue. Setting start latch 46 actuates single shot (SS) 102 to reset stop latch 100 after a time delay determined by SS 102 nonstable period.

The signal content of shift register 58 is shifted to the right, as viewed in the figure, once each image cycle. In this regard, timing circuits 60 provide a time delayed image-indicating pulse over line 75, which follows the line 64 pulse by less than one millisecond. Line 75 signal shifts the signal content of shift register 58 to the right once each image cycle, i.e., once each half rotation of copy drum 10.

The signal contents of shift register 58 cooperate with other portions 48 for controlling the reproduction processes. In this regard, cable 76 carries signals from shift register 58 to other portions 48 for enabling process control functions beyond the scope of the present description. Additionally, other process control functions are selectively activated by the shift register 58 signals via AND circuit 77. AND circuit 77 responds to the precondition latch 40 being reset to pass the control signals over cable 78 to other portions 48. Those reproduction processes disabled during the preconditioning mode include the panel 50 displays except for a standby indicating signal, as later described. Also paper path functions are inhibited, such as picking a blank sheet of copy paper or advancing a roll of supply paper (not shown), all detaching functions from the xerographic fuser (not shown), a billing meter (not shown) such that the user will not be charged for operations during the preconditioning mode, a fuser roll (not shown) closure such that no fusing action will take place, a document scanning lamp (not shown), paper path misfeed checking (not shown), and interimage erase (not shown). The latter inhibited function prevents the erase lamp from turning off between image cycles during the preconditioning mode. That is, to completely irradiate the newly received photoconductor elements, the erase lamp is on continuously during the preconditioning mode because AND circuit 77 blocks interimage turnoff functions. The apparatus in other portions 48 which respond to shift register 58 supply signals over cable 76 and are not inhibited during the preconditioning mode. These are the high-voltage coronas (not shown), the conveyor (not shown) for supplying toner to the xerographic reproduction station (not shown) and, hence, to the newly received photoconductor elements 13 and 13A, the electrical power the developer magnetic brush (not shown which, incidentally, is kept at a lowest possible voltage), and the copy detach air supply (not shown). The latter is operated even though it is closely associated with paper path transports to prevent an undue buildup of air pressure in a tank reservoir (not shown) thereby providing a good safety factor in the operation of the document reproduction machine.

During the preconditioning mode, the document reproduction machine may be subjected to interruptions of operation caused by someone opening a panel on the machine (not shown) or the machine being placed in a maintenance or CE mode. In spite of such intended or unintended interruptions, the preconditioning mode must be completed as originally contemplated. Accordingly, the illustrated circuits must automatically restart the machine in the preconditioning mode upon occurrence of any of the above-described interruptions. The interruptions of the machine processing are processed by circuits 45. For example, if a panel is opened on the machine, exposing high voltage to an operator, everything must stop. To this end, an interlock signal on line 80 signifies that all panels and doors are properly closed. If any panel or door is opened, the line 80 interlock signal is removed. When active, the line 80 interlock signal passes through OR circuit 81, thence to line 44 for enabling AND circuit 43 to set start latch 46, as previously described. The line 44 signal also goes to an inverter circuit 82, thence to AND circuit 83. AND circuit 83 responds to the inverse of the line 44 signal to pass a power derived timing signal received over line 84 from timing circuit 60 to reset run latch 53 and also provides a turnoff procedure to other portions 48, such as removing high voltage, but maintaining low voltage such that machine state indications of the document reproduction machine can be maintained. In this regard, preconditioning latch 40 is not altered during such interruption.

The second source of interruption is during the maintenance mode. AND circuit 86 responds to a maintenance or CE (customer engineer) mode being selected and to a momentary run switch (MRS) being depressed, as signified by the signal on line 87, to pass an AND circuit enabling signal through OR circuit 81. If, during the maintenance mode, the MRS is opened, AND circuit 86 removes the enabling signal thereby activating AND circuit 83 to prevent operation of the document reproduction machine. Upon restoration of the enabling signal on line 44, start latch 46 is again set to the active condition. It must be remembered that preconditioning latch 40 was in the set condition, providing an AND circuit enabling signal over line 42. Start latch 46 being set again sets run latch 53 and all procedures of the preconditioning mode are restored to the conditions immediately prior to interruption. Start latch 46 being set actuates single shot circuit 102 to reset stop latch 100 conditioning this latch to respond to the line 68 compare signal.

When run latch 53 is reset during an interruption, shift register 58 has to start out again from the lowest-order digit position 0. To this end, timing circuits supply an AC power synchronous timing signal over line 90 to AND circuit 91, which is enabled by run latch 53 being reset. AND circuit 91 then resets all stages of shift register 58 to the zero condition.

Additionally, during a preconditioning mode, it is desired that no signals from panel 50 travel through AND circuits 51 to select register 41. In this regard, the preconditioning latch 40 supplies an activating signal to standby circuit 95 which supplies an LED display indicating standby for operator observation. It also supplies a disabling signal over line 96 preventing AND circuit 51 from transferring any operator initiated signalling to select register 41.

Preconditioning photoconductor is achieved by electrostatic exposures, by mechanical actions, or by combinations thereof. The combined preconditioning results in a faster preconditioning. When mechanical action is included in preconditioning as by placing developer beads with toner on the photoconductor, it is preferred the toner laden beads be removed from the photoconductor during the process. Mechanical action need not include toner laden beads, but can be by a rotating brush or other forms of cleaning contacts. Electrostatics can also be only used for preconditioning. Many electric or mechanical actions may be used.

While the invention has been particularly shown and described with reference to a preferred embodiment thereof, it will be understood by those skilled in the art that various changes in form and detail may be made therein without departing from the spirit and scope of the invention.

What is claimed is:

1. A document reproduction machine having means for substituting a new image transfer surface means for a used image transfer surface means, means indicating that said new image transfer surface means is in a predetermined position with respect to said substitute means, said machine being operable in successive machine cycles;

the improvement including, in combination:

means for initiating a preset number of said machine cycles and including means for cycling said machine for said preset number of machine cycles;

means for inhibiting document reproduction during said preset number of machine cycles; and control means being responsive to said indication of said predetermined position to actuate said initiating and inhibiting means.

2. The document reproduction machine set forth in claim 1 wherein said machine has machine cycle interruption means, further including in combination:

means responsive to said machine cycle interruption means for interrupting said initiating and inhibiting means; and means for reactuating said initiating and inhibiting means upon completion of said interruption.

3. The document reproduction machine set forth in claim 1 including means responsive to said initiating means to irradiate said new image transfer surface means during said preset number of machine cycles.

4. A document reproduction machine set forth in claim 3 further including toner means for introducing toner to said new image transfer surface means during said preset number of cycles and including means for cleaning said new image area.

5. A document reproduction machine set forth in claim 1 including means actuatable when said new image transfer surface means being in a fully operative position to actuate said indicating means to indicate said predetermined position.

6. A cyclically operable document reproduction machine having means for receiving a new image transfer surface portion including means indicating reception of said new image transfer surface portion, the improvement including:

means for preconditioning said new image transfer surface portion for imparting predetermined physical characteristics to said new portion for facilitating quality image transfer by subsequent electric charging and discharging of said new portion;

means responsive to said indicating means for actuating said preconditioning means for operating said document reproduction machine a predetermined time; and means responsive to said indicating means to inhibit interference with said preconditioning.

7. The cyclically operable document reproduction machine set forth in claim 6 further including machine cycle counting means, each machine cycle requiring a predetermined elapsed time; and said preconditioning means having means responsive to said cycle counting means for indicating that a predetermined time has elapsed and for terminating said preconditioning mode.

8. The cyclically operable document reproduction machine set forth in claim 7 further including interruption means and further having control means responsive to said interruption means for interrupting said preconditioning mode; and means in said preconditioning means to re-establish said preconditioning mode operations after an interruption without detracting from said predetermined time.

9. The cyclically operable document reproduction machine set forth in claim 6 further including an image area erase unit normally turned on for erasing image transfer portions and off in inter-image portions, said portions constituting a transfer unit; and means responsive to said indicating means to inhibit turning off said image area erase unit.

10. A method of operating a document reproduction machine having a photoconductor element with portions movably mounted for movement to permit successively moving unused portions thereof to an operative position for renewing an image transfer area, including the following steps:

advancing a photoconductor element portion from a supply unit toward an operating position;

establishing a preconditioning mode in said machine;

cycling said machine a present number of times during said preconditioning mode for achieving said preconditioning for said predetermined time;

tallying said cycles;

releasing said machine from said mode after said preset number of cycles;

indicating that copies can be made from said advanced photoconductor element portion; and enabling interruption of said cyling without detracting or altering the preset number of cycles for said preconditioning.

11. The method set forth in claim 10 further:

inhibiting first predetermined machine functions during said preconditioning mode;

altering second predetermined machine functions during said preconditioning mode;

said first predetermined functions relating to reproduced copy handling; and said second predetermined functions relating to photoconductor element processes.

* * * * *